United States Patent [19]

Appierto

[11] Patent Number: 5,058,193

[45] Date of Patent: Oct. 15, 1991

[54] ELECTRIC HAIR-DRYER ADAPTED TO BE MOUNTED ON THE BACK OF A HAND

[76] Inventor: Anna N. Appierto, Via Pieve di Cadore, 30, 00135 Rome, Italy

[21] Appl. No.: 507,816

[22] Filed: Apr. 12, 1990

[30] Foreign Application Priority Data

Apr. 13, 1989 [IT] Italy ..... 53023/89[U]

[51] Int. Cl.[5] ..... A45D 20/10; F24H 3/04

[52] U.S. Cl. ..... 392/384; 34/97; 392/365

[58] Field of Search ..... 392/383–385, 392/389, 380, 365–368; 34/96–101, 243 R

[56] References Cited

U.S. PATENT DOCUMENTS

| | | | |
|---|---|---|---|
| 818,618 | 4/1906 | Fraley . | |
| 1,630,115 | 5/1925 | Duprey . | |
| 1,720,302 | 7/1929 | Suter . | |
| 2,018,046 | 10/1935 | Wilson . | |
| 2,268,294 | 12/1941 | Mayer . | |
| 2,523,201 | 9/1950 | Ellis . | |
| 2,552,470 | 5/1951 | Wahlberg | 392/365 |
| 2,582,572 | 1/1952 | Tulk . | |
| 3,268,075 | 8/1966 | Edman et al. . | |
| 3,319,350 | 5/1969 | Hlubik . | |
| 3,418,452 | 12/1968 | Grabner | 392/384 |
| 3,497,774 | 1/1970 | Carbone | 392/384 X |
| 3,613,257 | 10/1971 | Yashiike et al. | 34/97 X |
| 3,939,850 | 2/1976 | Wahl | 392/384 X |
| 4,138,827 | 2/1979 | Baugh et al. . | |
| 4,605,020 | 8/1986 | Lavoie | 132/219 X |
| 4,620,374 | 11/1986 | Patterson | 34/97 |
| 4,759,135 | 7/1988 | Scivoletto . | |

FOREIGN PATENT DOCUMENTS

| | | | |
|---|---|---|---|
| 2932127 | 2/1981 | Fed. Rep. of Germany | 392/384 |
| 2951562 | 7/1981 | Fed. Rep. of Germany | 34/96 |
| 454686 | 5/1913 | France . | |
| 421405 | 3/1967 | Switzerland . | |
| 972682 | 10/1964 | United Kingdom | 392/381 |

*Primary Examiner*—Anthony Bartis
*Attorney, Agent, or Firm*—Sughrue, Mion, Zinn, Macpeak & Seas

[57] ABSTRACT

An electric hair dryer provided with an elongated rigid housing having inlet and outlet apertures at opposite ends is provided with an elongated handle secured to and spaced from the casing and extending lengthwise of the casing. The casing has a bottom surface facing the handle. The bottom surface is anatomically shaped to fit the back of a hand inserted between the bottom surface of the casing and the handle to support the hair dryer casing on the back of the hand.

6 Claims, 2 Drawing Sheets

ELECTRIC HAIR-DRYER ADAPTED TO BE MOUNTED ON THE BACK OF A HAND

BACKGROUND OF THE INVENTION

The present invention relates to an electric hair-dryer for professional or private use, and particularly to the shape of its grip.

Conventional hair-dryers have pistol grips which prevent the fingers of the hands gripping them from being able simultaneously to handle other objects. This makes the setting of the hair long and tedious. In fact, during the course of this operation, the hairdresser or the person arranging her own hair, grips the hair-dryer with one hand and grips a brush for curling the hair with the other hand. Each time a lock of hair has to be taken by one hand and wound around the brush, the user must put the hair-dryer down on a supporting surface so as to have a hand free to grip the lock of hair and to curl it round the brush, after which the hair-dryer can be picked up again to dry the curled lock.

SUMMARY OF THE INVENTION

The present invention provides a new and improved electric hair dryer which overcomes the above problem and in particular, makes the setting of hair quick and easy since it allows the hair dryer to be supported on the back of the hand with the fingers of the hand being left free to move and grip other objects.

The present invention provides a new and improved electric hair dryer having an elongated rigid casing adapted to be suppored on the back of a hand. The casing is provided with a rear end having an air inlet, a front end having an air outlet and a bottom surface. An elongated handle is secured to the bottom surface of the casing and extends lengthwise of the casing. The bottom surface of the casing opposite the handle is shaped anatomically with a certain concavity so as to fit the shape of the back of the hand. A switch for controlling the electric blower and heating element within the casing is mounted near the front end of the dryer for easy manipulation by the operator. The handle may be slightly inclined relative to the longitudinal axis of the casing which extends from the front end to the rear end. An annular support surface may be provided on the rear end about the air inlet to support the dryer on a flat surface when it is not being held.

BRIEF DESCRIPTION OF THE DRAWINGS

Advantages and characteristics of the present invention will become clear from the detailed description which follows with reference to the appended drawings, provided by way of non-limiting example, in which.

DETAILED DESCRIPTION OF THE INVENTION

Figure 1:
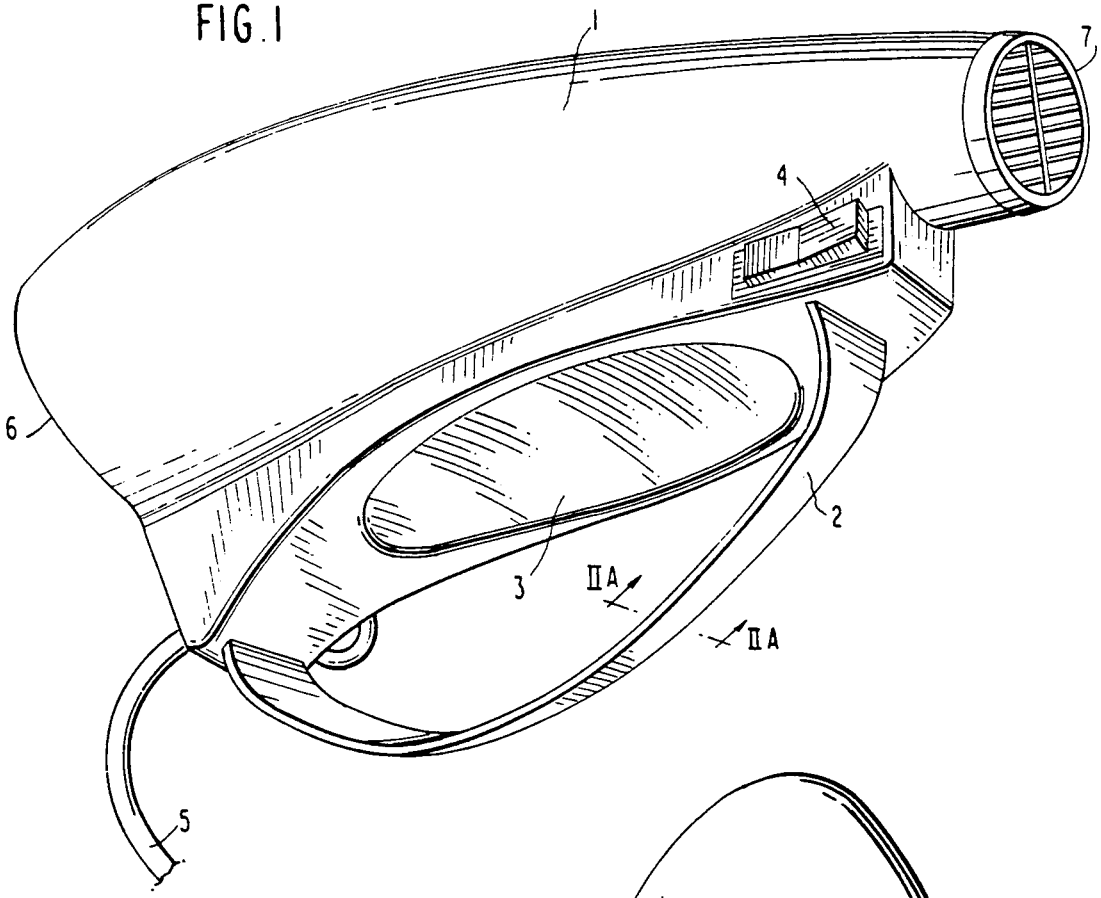
FIG. 1 is a perspective view of a hair-dryer according to the invention.
Figure 2:
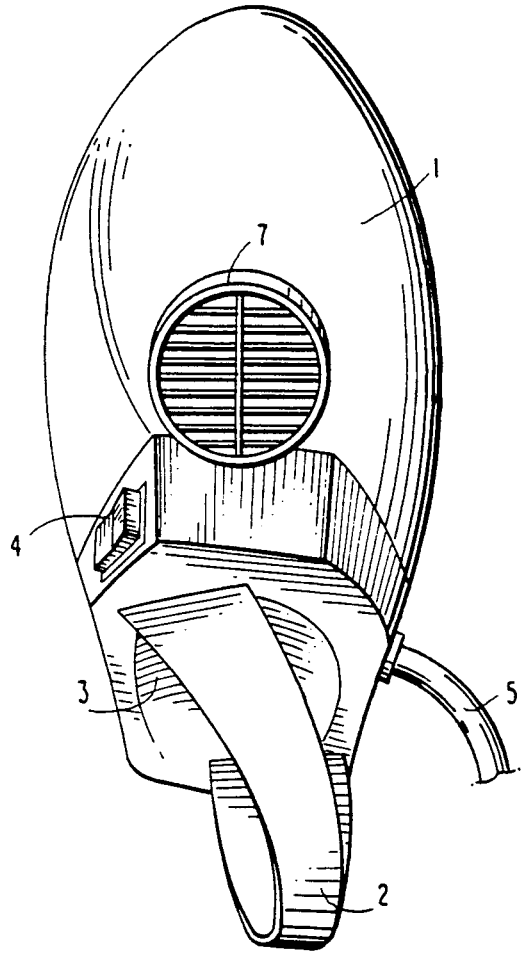
FIG. 2 is a front view of a hair-dryer according to the invention.
Figure 2A:
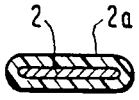
FIG. 2A is a cross-sectional view taken along the line IIA—IIA in FIG. 1.

An electric hair-dryer (FIGS. 1 and 2) comprises a rigid casing 1 with a bridge-like grip 2 which is inclined to the longitudinal axis of the hair-dryer and is covered by an elastomeric material 2*a*, such as rubber, possibly of the type with a high coefficient of friction as shown in FIG. 2A. The surface 3 of the rigid casing 1 which faces the grip 2 is shaped anatomically with a certain concavity, so as to fit the shape of the back of the hand. The distance between the surface 3 and the grip 2 is greatest in correspondence with the central region and decreases gradually towards the ends.

Figure 4:
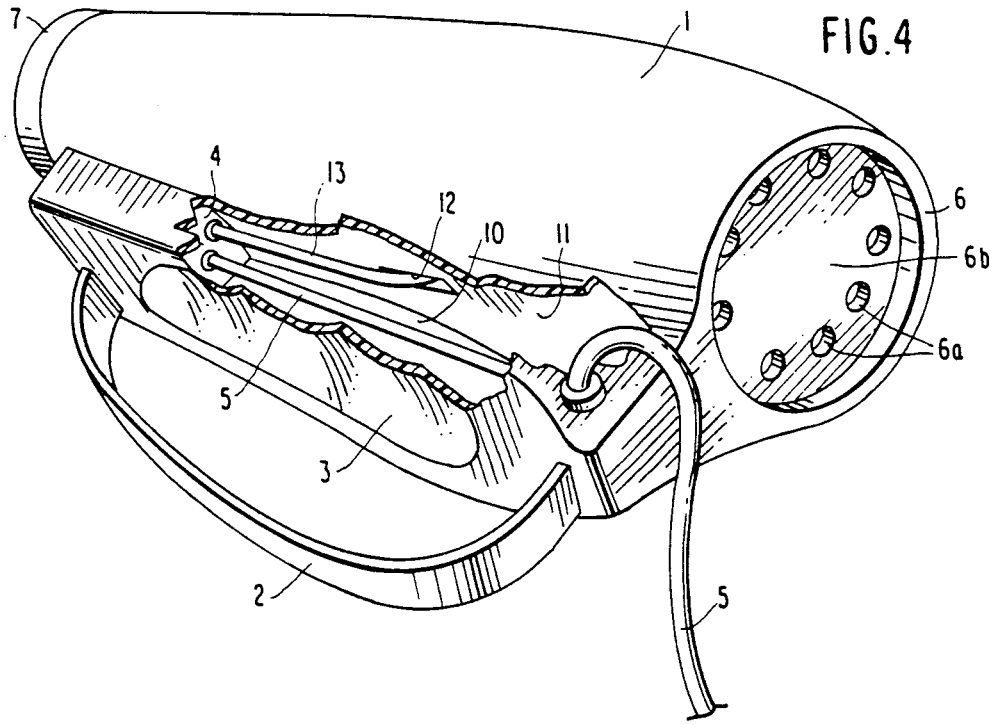
FIG. 4 is a further, partially-sectioned, perspective view of the hair-dryer.

A switch 4 for switching on the electrical devices of the hair-dryer (the electric fan and heating resistance) is provided adjacent one end of the grip 2 and is supplied by means of a cable 5 which enters the casing 1 through a hole in its left-hand side wall (FIG. 4). The details of the electrical devices have not been illustrated, since they are of known type and do not fall within the scope of the present invention. Moreover, the omission of these details from the drawings makes the latter more readily understood.

The wall 3 faces an internal chamber 10 (FIG. 4) which is separated by a wall 11 from the main cavity of the casing containing the electrical fan and resistance. This chamber acts as a heat insulator for the wall 3 and contains the length of cable 5 which is connected to the switch 4 and the supply cable 13 which passes through a hole 12 in the wall 11.

The casing 1 has an annular flat surface 6 usable as a base for supporting the hair-dryer on a face opposite the air-outlet opening 7, the air-inlet holes 6*a* being formed in a central recessed wall 6*b* so as to avoid any contact between them and the supporting surface (which may, for example, be the wet surface of a wash-basin.

Figure 3:
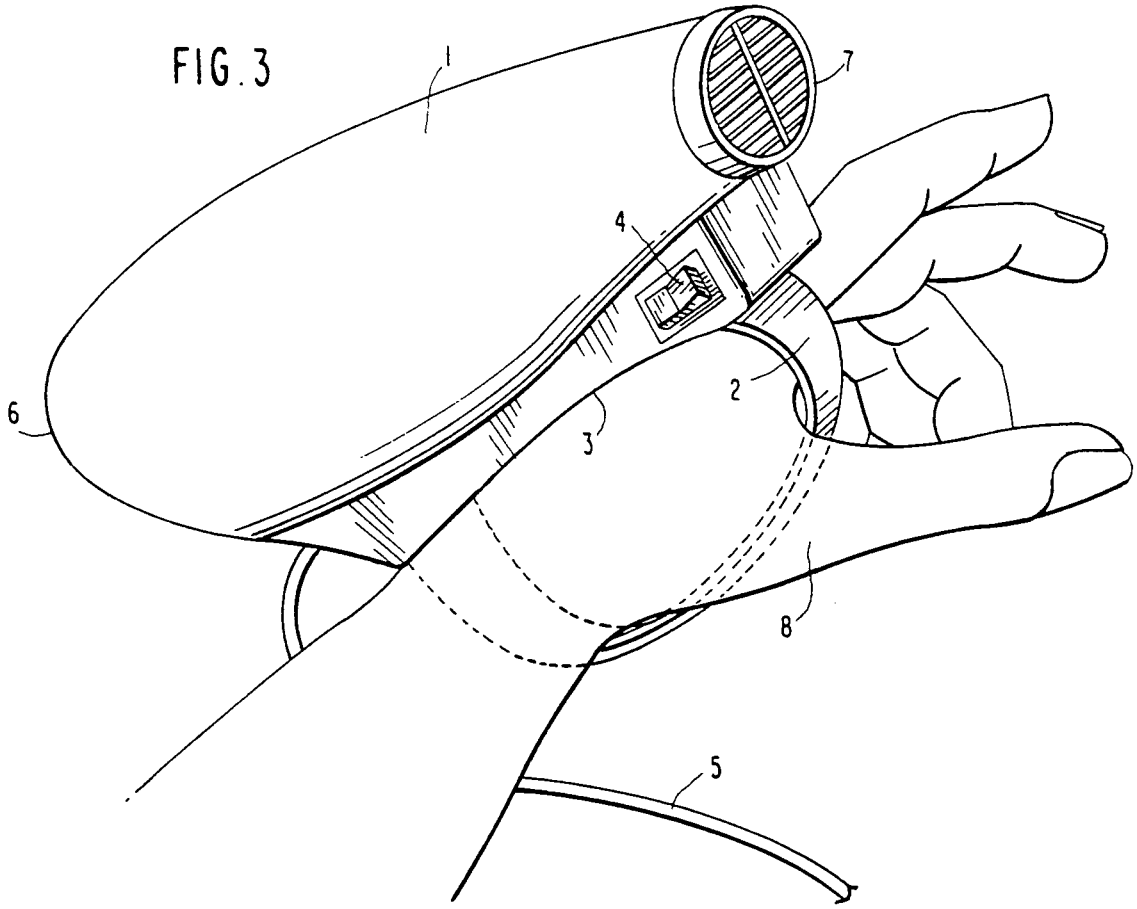
FIG. 3 shows the hair-dryer of the invention in the condition of use.

During use (FIG. 3), a hand 8 is inserted between the grip 2 and the adjacent surface 3 of the casing 1 so as to hold the hair-dryer, and the weight of the latter is discharged on the back and side of the hand 8 to leave the fingers free to move. Thus, when the hair is being set, the fingers of the hand 8 inserted in the grip 2 can take a lock of hair and wind it a round a brush held by the other hand, without the need to put the hair-dryer down each time this is done.

By virtue of the particular positioning of the switch 4, it can be operated by the thumb of the hand 8 inserted in the grip 2.

In a possible variant (not illustrated), the grip of the hair-dryer may be formed by a strip of rigid plastics which can slide in a buckle fixed to the casing, enabling the grip to be adapted to hands of different sizes by the adjustment of the useful length of the strip.

Naturally, the scope of the present invention also extends to models which achieve equal utility by means of the same innovative concept.

What is claimed is:

1. An electric hair dryer adapted to be mounted on the back of a hand, comprising an elongated rigid casing having a front end, a rear end and a bottom surface, an air inlet located in said rear end, an air outlet located in said front end and an elongated hand grip secured to and spaced from the bottom surface of said casing and extending lengthwise of said elongated casing with said bottom surface of said casing facing said hand grip being shaped anatomically so as to fit the shape of the back of a hand whereby upon insertion of a hand between said hand grip and said bottom surface so as to hold the hair dryer said casing will be supported on the back of said hand.

2. An electric hair dryer as set forth in claim 1, wherein said hand grip is covered by an elastomeric material.

3. An electric hair dryer as set forth in claim 1, further comprising a switch for controlling the operation of the hair dryer mounted on said casing adjacent said front end.

4. An electric hair dryer as set forth in claim 1, wherein said casing has a longitudinal axis extending from said front end to said rear end and said hand grip is inclined to said longitudinal axis.

5. An electric hair dryer as set forth in claim 1, wherein said casing has a flat surface on said rear end for supporting said hair dryer.

6. An electric hair dryer as set forth in claim 5, wherein said flat surface is an annular surface surrounding a central recessed surface in which air inlet holes are formed.

* * * * *